RIBBON CARTRIDGE

BACKGROUND OF THE INVENTION

1. Field of the Invention

This invention relates to ribbon cartridges, such as used in typewriters, printers and the like.

2. Description of Prior Art

Prior cartridges of the type described comprise a ribbon wound on a supply spool which is wound up on a take up spool which is rotated by a driving roller according to desired printing operation. The take up spool, of such known ribbon cartridges, is adapted to be driven by the driving roller so that the take up spool will wind the ribbon by a fixed length during each printing operation. However, disadvantageously, the ribbon is often loosened or excessively tightened between the supply spool and the take up spool due to variations in tension applied to the ribbon. Thus, it is difficult to wind the ribbon by a precise predetermined length during each printing operation.

According to a known method of stabilizing the tension of the ribbon supplied by a supply spool, the ribbon, wound on the supply spool, is pressed against the inside wall surface of the cartridge by a spring member, to apply frictional resistance of the wall surface of the ribbon. This method, however, is unsatisfactory because it is difficult to apply an appropriate frictional resistance at all times to the ribbon.

Thus, with prior art devices, it is difficult to attain reliable, constant and precise amount of tension at all times.

SUMMARY OF THE INVENTION

Accordingly, an object of the invention is to overcome the foregoing and other disadvantages and deficiencies of the prior art.

Another object is to provide a ribbon cartridge of simple construction which is capable of applying an appropriate frictional resistance to the ribbon at all times and thus maintain a predetermined tension on the ribbon at all times.

A further object is to provide a ribbon cartridge capable of continually maintaining a predetermined tension on the ribbon even if the biasing force of a spring member used for pressing the ribbon against the inside wall surface of the casing changes due to the reduction in diameter of the ribbon wound on the supply spool.

The foregoing and other objects are attained by the invention which encompasses a ribbon cartridge comprising a case, a supply spool disposed in the case for carrying a supply of wound up ribbon; a take up spool disposed in the case for winding up the ribbon supplied by the supply spool; a spring member for biasing the supply spool so that the ribbon wound thereon is pressed continually against the inside wall surface of the case; wherein the inside wall surface has an irregular, rough surface in the area whereat the ribbon is in contact with the inside case surface and the rough surface is of varying frictional resistance.

DETAILED DESCRIPTION OF PREFERRED EMBODIMENTS

Figure 1:
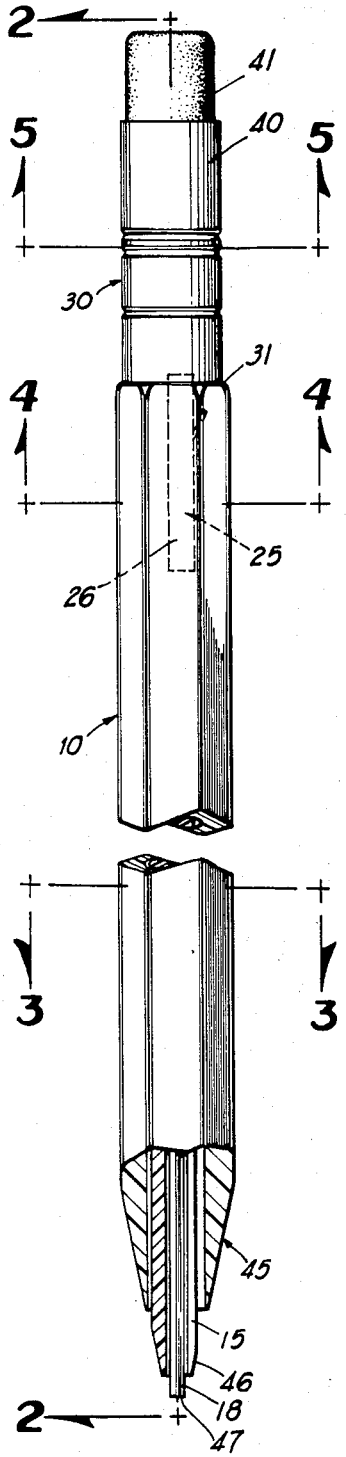
FIG. 1 is a plan view of an illustrative embodiment of the invention.

Referring to FIG. 1, there is depicted a cartridge comprising a lower case 4 containing supply spool 2, take up spool 6, drive roller 7 and springs 3 and 8. The upper case is removed to show the contents of the cartridge, and to simplify the description. Guide hole or channel 9 is representationally depicted as though the upper case were present, and is so to be understood.

In FIG. 1, torsion spring 3 is depicted having one end **3*a* fitted in a hole formed at the center of a supply spool 2, carrying a supply of a ribbon 1 wound thereon, to support supply spool 2 rotatively; a coiled part 3*b* fit around a pin 5 fixedly provided on lower case 4 and another end 3*c* attached to or placed against the inside wall surface of lower case 4. Thus, spring 3 biases supply spool 2, rotatably supported by end 3*a*, continually in a clockwise direction so that ribbon 1 wound on supply spool 2, is kept in continual contact with the inside surface wall A of lower case 4**.

A takeup spool 6 for taking up ribbon 1 after use, is rotated by a driving roller 7, connected to a driving shaft of a motor, not shown, and provided with a plurality of teeth **7*a* along the circumference thereof. A torsion spring 8 engaging a center stud 6*a* of takeup spool 6, biases takeup spool 6 continually in a counterclockwise direction so that takeup spool 6 is pressed continually against drive roller 7 and the driving power of drive roller 7 is transmitted reliably to take up spool 6. A guide slot 9 is formed in the upper case, not shown, to guide the center stud 6*a* of spool 6, as spool 6 moves clockwise with the increase in diameter of the wound up ribbon 1, as the ribbon 1 is wound up on take up spool 6**. For sake of simplicity the used tape being wound on the spools is shown in the drawing as being partly in dotted lines and remainder in solid line.

Ribbon 1 is drawn out from supply spool 2 and is wound up on take up spool 6 through a path comprising ribbon outlet 11 and ribbon inlet 12 formed in the extremities of arms 10 of case 4, respectively.

FIGS. 2A and 2B depict examples of compositions, shapes and configurations of the inside wall surface A of lower case 4 against which ribbon 1 is kept in constant contact during the time supply spool 2 is being used, namely from the time of being fully loaded to being completely exhausted.

In one embodiment, inside wall surface A, as shown in FIG. 2A, is manufactured in a manner to form dots 13. Dots 13 decrease gradually in size from a position B where ribbon 1 is wound fully (i.e. fully loaded) on supply spool 2 toward a position C where the ribbon 1 is in contact with the inside wall surface A when the ribbon 1 of supply spool 2 is exhausted (see FIG. 1).

Therefore, the area of contact between ribbon 1 and inside wall surface A, hence, the frictional resistance against the movement of ribbon 1, increases as the position of contact between ribbon 1 and inside wall surface A changes from position B to position C. Although the resilient force of torsion spring 3 that works on supply spool 2 gradually decreases as the diameter of the wound up ribbon 1 on supply spool 2 decreases, the reduction of resilient force of torsion spring 3 is compensated by the increase of frictional resistance. Consequently, the friction between ribbon 1 and inside wall surface A remains substantially constant regardless of the diameter of the wound up ribbon 1 on supply spool 2.

MECHANICAL PENCIL WITH SELF-TAPPING PROPELLING NUT AND THE METHOD OF PRODUCING SAME AND PROPELLING A LEAD CONTAINED THEREIN

BACKGROUND OF THE INVENTION

1. Field of the Invention

This invention relates to a mechanical pencil and the method of propelling a lead contained therein.

2. Description of the Prior Art

Mechanical pencils are known that have a barrel, a split tube within the barrel and a nut for propelling a piece of lead down the split tube. In those pencils where the lead may be propelled and retracted, a clutch is commonly provided at the forward end of the split tube to retract the piece of lead thereby also projecting the nut backwards, with rotation of the split tube. Rotation of the split tube in the opposite direction will project the lead. Typical of this type is the pencil disclosed in U.S. Pat. No. 2,511,301 issued June 13, 1950 to Smith. The barrel is provided with an internal screw-thread, and the nut is externally threaded to engage the internal screw thread within the barrel. Relative circular motion of the split tube causes the nut to move helically up or down within the barrel with the respective threads of the nut riding within the internal threads of the barrel.

Such a pencil has proved highly successful as a reuseable mechanical pencil, but the manufacturing costs of a plurality of parts including a clutch assembly, plus the assembly costs of units having a number of parts have caused these pencils to be too expensive for a disposable unit. As disposable ball point and fiber tip pens have proved a ready market for disposable writing instruments, there is a need for a disposable mechanical pencil which is competitive with the conventional wood pencils which do not provide the available lead advancing means of mechanical pencils and which obviates the necessity of repeated sharpening associated with the "wood case" pencil.

SUMMARY OF THE INVENTION

The present invention is directed to a disposable pencil having an extruded barrel with an extruded split tube disposed therein which contains a non-circular pencil lead therein. A propelling means is slidably housed within the split tube through its transverse, longitudinally extending slot and has an outwardly extending angled ear which cooperates with the interior of the extruded barrel so that rotation of the split tube within the barrel enables the propelling means to progressively tap its way down the barrel by cutting into the interior of the barrel a spiral thread or path and thus advance the lead within the split tube to a writing position beyond its forward end.

Also, the present invention is directed to a method of propelling a lead in a mechanical pencil wherein the drive member that is housed in the split tube taps a spiral thread or path within the barrel to allow its advancement to project the lead.

BRIEF DESCRIPTION OF THE DRAWING

Figure 2:
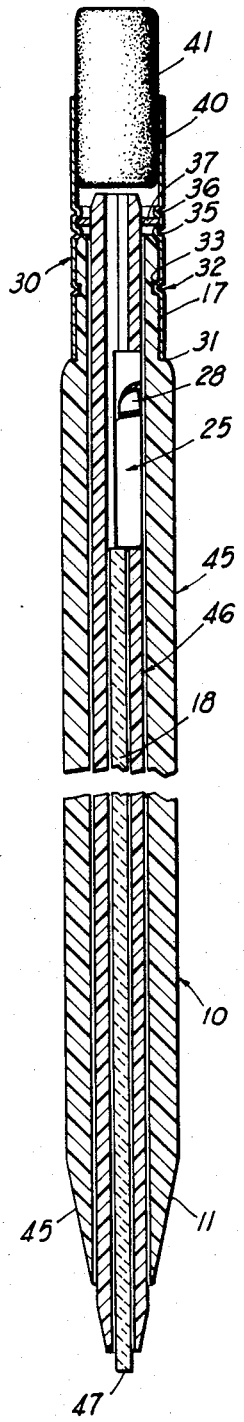
FIGS. 2A and 2B are front elevational views depicting two alternative configurations of the inside wall surface.
Figure 3:
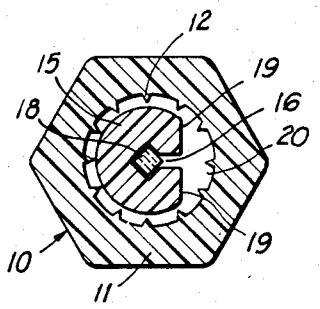
Figure 4:
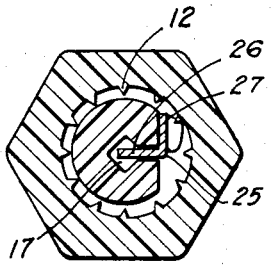
Figure 5:
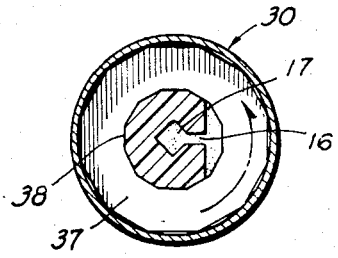
Figure 6:
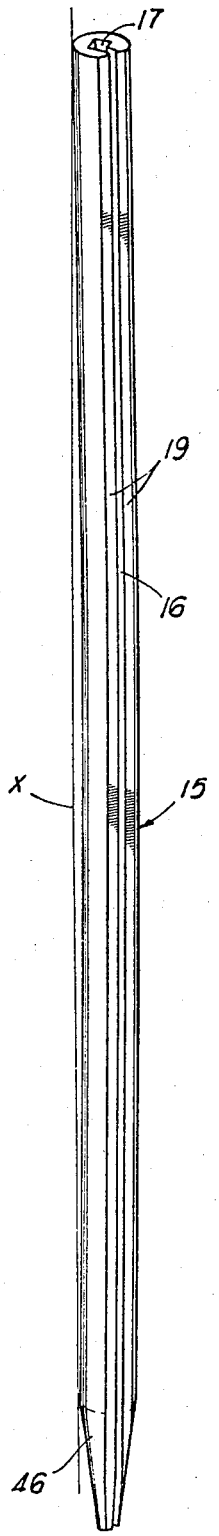
Figure 7:
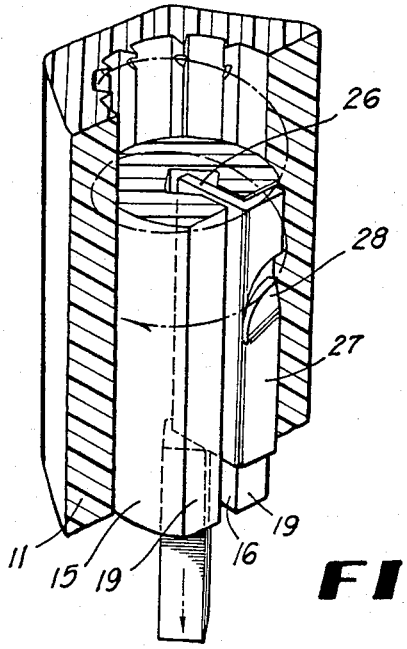

FIG. 1 is an enlarged side elevational view of a pencil according to the invention, partially sectioned, and broken to shorten the view;

FIG. 2 is a longitudinal cross-section taken along line 2—2 in FIG. 1;

FIG. 3 is a horizontal cross-section taken along line 3—3 in FIG. 1;

FIG. 4 is a horizontal cross-section taken along line 4—4 in FIG. 1;

FIG. 5 is a horizontal cross-section taken along line 5—5 in FIG. 1;

FIG. 6 is a perspective view of a split tube of the present invention;

FIG. 7 is an enlarged detail perspective view partly in cross-section showing the manner of tapping the splines and advancing the lead through the cooperation of the split tube drive means and splines of the barrel.

Figure 8:
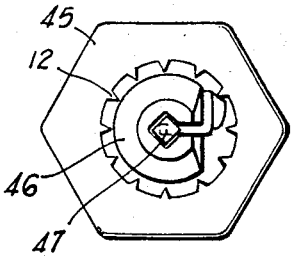
Figure 9:
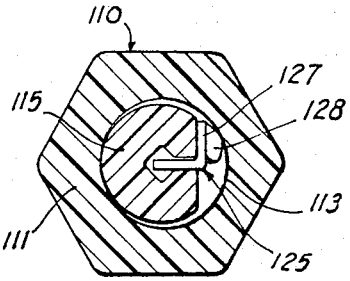

FIG. 8 is an enlarged front view of the point portion of the pencil;

FIG. 9 is a horizontal cross-section similar to FIG. 4 of a second embodiment of the invention.

DESCRIPTION OF THE PREFERRED EMBODIMENT

The invention relates to a mechanical pencil having few parts, which is easily and economically produced at sufficiently low cost to be a truly disposable mechanical pencil. By dispensing with the clutch and other complex portions of mechanical pencils heretofore produced and marketed, this new pencil can be used to competitively replace conventional wood case pencils which have the disadvantage of requiring repeated sharpening.

Referring particularly to FIGS. 1, 2 and 3, a mechanical pencil 10 is shown having an extruded barrel 11 provided with a plurality of inwardly projecting, axially disposed splines 12. The outside of the barrel may be conventionally shaped in a 0.300 inch hexagon. The internal bore may be generally round in transverse cross-section, as shown in FIGS. 3–5, with the exception of the splines 12. The barrel may be produced from an easily extruded material, with extruded polypropylene being the preferred material. Several beads are provided at the ear end of the barrel and they are discussed below.

Fitted inside the bore of the barrel is a second tubular extrusion in the form of a split tube 15 extending longitudinally beyond the barrel at both the forward and rear ends thereof. Referring particularly to FIGS. 3 and 6, split tube 15 is provided with a transverse, longitudinally extending slot 16 communicating with an internal square bore 17 adapted to receive a square piece of pencil lead 18 of conventional material such as graphite. One corner of the square piece of lead 18 may extend into the inner end of the slot 16, as is seen in FIG. 3.

The slight bowing inherent in the piece of lead 18 and its increased surface area because of its square shape provide adequate friction to prevent the lead from falling out of the split tube 15, even though no clutch at the forward end of the pencil holds the lead in. The square shape of the lead 18 and the internal square bore 17 also prevent rotation of the lead relative to the split tube 15. If the lead could freely rotate, it would not retain its point during use. If desired, the split tube 15 may be slightly bowed after extrusion to help hold the lead 18 in place, but this should not be necessary.

The split tube is cut longitudinally along a chord of its transverse circular section generally perpendicular to the longitudinally extending slot 16. As a result, a flat portion 19 is formed on either side of the transverse longitudinally extending slot 16 and a gap 20 is left inside of the barrel 11 which is not filled by the split tube 15.

As can be seen in FIGS. 4 and 7, a propelling means such as a nut 25 of metal such as beryllium, copper or spring steel is inserted in the rear section of the internal bore of the barrel 11 rearwardly of lead 18, with a transverse portion 26 projecting through the transversely extending longitudinal slot into the internal bore 17. The nut 25 also has a horizontally extending leg 27, which with transversely extending portion 26 forms an L-shaped member. The horizontally projecting portion 27 rests on one flat portion 19 of the split tube 15 when the nut 25 is interted in the transverse longitudinally extending slot 16.

As may be seen in FIG. 7, an angled outwardly extending ear 28 is cut away from horizontally extending leg 27, springably projecting in an angular fashion outwardly therefrom. The ear 28 is sufficiently large and stiff to reach the exterior of the gap 20 and deformably engage the inwardly projecting splines 12 of the barrel 11. It should be noted that the splines 12 extend straight in a longitudinal direction while the ear 28 is cut and bent at a diagonal of some 10° from the horizontal of the leg 27 toward the longitudinal direction of the splines 12. This angle can be chosen anywhere below 30° to assure no retraction from back pressure.

Referring to the rear portion of the pencil shown in FIGS. 1 and 2, and particularly the transverse cross-section in FIG. 5, a ferrule 30 is provided about the rear portion of the barrel 11. The ferrule 30 is adapted so that upon rotation of the ferrule 30 with respect to the barrel 11, the split tube 15 is also rotated with respect to the barrel 11. In particular, the ferrule 30 abuts a ledge 31 in barrel 11, so as to limit its movement in a longitudinal direction. A transverse circular bead 32 is indented in the ferrule 30 rearwardly of ledge 31 and a circular groove 33 is machined into the barrel 11 at a similar longitudinal position so as to engage the bead 32 permitting rotation but preventing axial motion in the longitudinal direction. Rearwardly of the bead 32 in the ferrule 30 are two indents 35 and 36, both circular in shape, adapted to receive therebetween a washer 37 disposed rearwardly from the barrel, which in turn engages the split tube 15 at its interior edge 38, as can best be seen in FIG. 5. It should of course be understood that split tube 15 must project rearwardly beyond the rear end of barrel 11 in order for washer 37 to engage both the ferrule 30 and the split tube 15 so as to coordinate the rotation of the ferrule 30 and the split tube 15 relative to the barrel 11.

Referring again to FIGS. 1 and 2, the rear portion 40 of ferrule 30 acts as an eraser holder, to engage eraser 41 interiorly of the ferrule 30. As the pencil 10 is designed for economical construction without provision being made for a refill of pencil lead 18, the eraser 41 may also be designed for disposability, without the usual need to adapt eraser 41 for replacement inside of rear portion 40 of ferrule 30. Thus a pure rubber or similar synthetic material eraser 41 can be used without any metal or hard plastic attachments fitted onto the eraser.

Referring to the forward portion of the pencil, as can best be seen in FIGS. 1, 2 and 8, the front end of the split tube 15 can be seen to project forwardly beyond the front end of the barrel 11. The conical shape of a wood case pencil is approximated by a conical cut 45 machined in the forward portion of extruded barrel 11, a conical cut 46 machined in the forward portion of extruded split tube 15, and the forward tip 47 of the pencil lead 18 extending forwardly beyond the forward end of split tube 15.

In operation, when advancement of lead is desired, the user rotates ferrule 30 in the direction shown in FIG. 5 simultaneously rotating the washer 37 in the same direction, and the split tube 15 is thereby also rotated, carrying with it the nut 25 having the angle ear 28, as can be seen in FIG. 7. The ferrule 30, the washer 37, and the split tube 15 are all prevented from axial motion in the longitudinal direction because of the position of the bead 32 in the groove 33 and the abutting of ferrule 30 against the ledge 31 of barrel 11. However, nut 25 is not inhibited from axial motion in the longitudinal direction and, because of the angle at which ear 28 is slanted with respect to the longitudinally extended splines 12, upon rotation of the split tube 15 and with it the nut 25, the nut is advanced in a helical fashion forwardly down the interior of barrel 11 cutting through the splines 12, always maintaining the same transverse position relative to the split tube 15, all of which can be seen in FIG. 7. Thus the nut progressively projects the piece of pencil lead 18 out the split tube end, because transversely extending leg 26 of nut 25 extends into the internal square bore 17.

It should be apparent to those skilled in the art that the present invention provides an easily assembled, economical, mechanical pencil which can be automatically assembled, and made through extrusion techniques, and by the elimination of the clutch found in conventional mechanical pencils, can be made inexpensively enough for the pencil to be disposable. There is also no need to provide a replaceable eraser, clip or metal tip, because the entire pencil is designed to be disposable.

The pencil may be easily and automatically constructed by cutting predetermined lengths of barrel and split tube from continuously extruded spaghetti-like tubes. The appropriate groove, diagonal cuts and ledge are then machined. One can then insert the lead and nut in the split tube after which the split tube assembly is inserted in the barrel. Alternatively, the split tube is inserted in the barrel (with or without lead) and then the lead and the nut are inserted from the back end. In either case the spring of the angled ear permits the nut to be inserted into the back end of the barrel by compressing against the leg 27, and, additionally, the straight longitudinal direction of the splines permits the nut to be inserted without the cutting that later takes place on rotation of the ferrule.

The washer is inserted over the back of the barrel-split-tube assembly, tightly fitting over the back end of the split tube. The ferrule is then snap fitted over the washer with indents provided to hold the washer in place.

It will be appreciated that, as constructed, rotation of the ferrule projects and ejects lead only, and does not retract it. With minor modification, the pencil could be adapted for retraction.

A further embodiment of the pencil 110, shown in FIG. 9, in all other respects the same as the embodiment in FIGS. 1–8, eliminates the splines 12 from its barrel 111. Accordingly, the interior wall 113 of the barrel 111 is cylindrical. The angled ear 128 projecting from transverse leg 127 of nut 125 extends outwardly to interior wall 113. The nut 125 must meet equal resistance in self-tapping its way through the helical path cut into the interior of the barrel 111, rather than increased resistance whenever a spline is to be traversed. Insertion of nut 125 into the barrel 111 must be accomplished through compression of the angled ear 128 against the leg 127 in order to minimize cutting into the barrel 111. Of course, since the nut is usually inserted longitudinally into the barrel, any cut so made would not cause a problem of possible retraction of the pencil 110, once the angled ear had begun to cut its helical path.

The foregoing embodiments are for illustrative purposes only and it should be understood that the just described embodiments merely illustrate principles of the invention in preferred form. Many modifications, additions and deletions other than those specifically ilustrated may, of couse, be made thereto without departure from the spirit and scope of the invention as set forth in the following claims.

What is claimed is:

1. In a mechanical pencil of the type including a barrel having a rear portion adapted to hold a ferrule and a forward portion with a conical end, a tube formed with a longitudinal slot therein disposed within said barrel, means to cause relative rotation between said tube and said barrel and a writing lead propelling means mounted to travel longitudinally in said slot of said tube, the improvement comprising: an axially moveable writing lead propelling means having an angled outwardly extending ear which upon forward longitudinal axial movement engages and cuts into the interior of said barrel thereby forming a helical path responsive to rotation of said tube with respect to said barrel, whereby writing lead may be projected forwardly and outwardly from said barrel and said tube.

2. In a mechanical pencil, the improvement claimed in claim 1 wherein said tube and said barrel are extruded.

3. In a mechanical pencil, the improvement claimed in claim 1 wherein said barrel includes a plurality of longitudinally extending splines projecting inwardly from said barrel and said angled outwardly extending ear engages said splines to form said path.

4. In a mechanical pencil, the improvement claimed in claim 1 wherein said slot is formed radially to the longitudinal axis of said tube and said tube being further formed with a longitudinally extending flat side and an arcuate portion, said flat side being a chord of the circle formed by said arcuate portion.

5. A mechanical pencil of the type claimed in claim 4 wherein said slot is formed perpendicular to said flat side.

6. In a mechanical pencil, the improvement claimed in claim 1 further comprising a ferrule rotatably fitted around the rear portion of said barrel extending longitudinally rearwardly therefrom and a washer engageably fitted inside said ferrule, said tube extending longitudinally rearwardly from the rear end of said barrel; said washer engaging the rear portion of said tube whereby rotation of said ferrule relative to said barrel causes rotation of said washer and said tube relative to said barrel and helical motion of said ear of said propelling means relative to said barrel.

7. In a mechanical pencil, the improvement claimed in claim 1 wherein said tube is provided with a longitudinally extending square internal bore communicating with said slot and adapted to receive a square pencil lead therein.

8. In a mechanical pencil, the improvement claimed in claim 1 wherein said tube extends longitudinally forwardly of the forward end of said barrel.

9. In a mechanical pencil, the improvement claimed in claim 8 wherein said forward portion of said barrel is cut in an inwardly sloped conical fashion and the forward portion of said tube is cut in an inwardly sloped conical fashion, said forward portions aligning therebetween in a conical fashion.

10. In a mechanical pencil, the improvement claimed in claim 1 wherein said barrel and said tube are cut at predetermined lengths from lengths of extruded tubes.

11. In a mechanical pencil, the improvement claimed in claim 1 wherein said propelling means includes a leg extending radially into said slot of said tube and a second leg extending perpendicularly to said first leg; and said ear projecting at an angle of less than 30° from the horizontal direction of said second leg.

12. In a mechanical pencil having a barrel containing a writing lead therein and an axially moveable propelling means disposed within the barrel and operably associated with the writing lead the improvement of said propelling means being a transversely L-shaped member with two legs being longitudinally extending and having an angled outwardly extending ear projecting from one leg thereof, said ear being resilient so as upon forward longitudinal axial movement it engages and cuts into the interior of the barrel a path to position the writing lead at an advanced position.

13. In a mechanical pencil having a writing lead contained therein for selective advancement, the improvement of a barrel being an extruded hollow member with a plurality of longitudinally extending splines projecting inwardly from the interior thereof, and an axially moveable lead propelling means operably associated with the barrel so as upon forward longitudinal movement it deformably engages said splines to form a path and position the writing lead at an advanced position.

14. A method of propelling lead out of a mechanical pencil comprising the steps:

rotating a split tube disposed within a barrel;

cutting a helical path in the interior of said barrel by longitudinally advancing a propelling means having an angled outwardly extending ear that deformably engages the interior of said barrel to form a helical path therein; and advancing a piece of lead in said split tube in response to the advancement of said propelling means.

15. A method as claimed in claim 14 wherein said barrel is provided with a plurality of longitudinally extending splines and said outwardly extending ear of said propelling means cuts said helical path through said longitudinally extending splines.

16. A method of constructing a disposable mechanical pencil comprising the steps:

(a) cutting off a predetermined length of an extruded barrel;

(b) cutting off a predetermined length of an extruded split tube;

(c) inserting a piece of lead in said extruded split tube;

(d) inserting an axially moveable self-tapping propelling means into said split tube that is adapted to engage and cut into the interior of said extruded barrel thereby forming a split tube assembly;

(e) inserting said split tube assembly into said barrel; and (f) attaching a ferrule and a washer at the rear portion of said barrel for rotating said split tube and advancing said lead.

17. In a mechanical pencil of the type including a barrel, a tube formed with a slot therein disposed within said barrel and adapted to receive a writing lead for advancement therein, a writing lead propelling means mounted to travel in said slot of said tube, and means for advancing said writing lead propelling means relative to said barrel and said tube, the improvement including an axially moveable writing lead propelling means having means to deformably engage the interior of said barrel thereby forming a path therein for positioning said writing lead at an advanced position.

18. In a mechanical pencil as defined in claim 17 wherein the tube and barrel are extruded.

19. In a mechanical pencil as defined in claim 17 wherein said tube extends forwardly of said barrel.

20. A method of propelling lead in a mechanical pencil comprising the steps of:

rotatably moving a slotted tube within a barrel;

advancing an axially moveable propelling means with respect to said slotted tube that deformably engages the interior of said barrel to form a helical path therein; and advancing a piece of lead in said slotted tube in response to the advancement of said propelling means.

* * * * *